US007727361B2

(12) United States Patent
Morton et al.

(10) Patent No.: US 7,727,361 B2
(45) Date of Patent: Jun. 1, 2010

(54) PAPERMACHINE CLOTHING

(75) Inventors: Antony Morton, Yorkshire (GB); Justin Alan Payne, Lancashire (GB); David Stuart Ponton, Lancashire (GB); John Jeffrey, Blackburn (GB)

(73) Assignee: Voith Patent GmbH, Heidenheim (DE)

( * ) Notice: Subject to any disclaimer, the term of this patent is extended or adjusted under 35 U.S.C. 154(b) by 775 days.

(21) Appl. No.: 11/521,056

(22) Filed: Sep. 14, 2006

(65) Prior Publication Data

US 2007/0066172 A1 Mar. 22, 2007

(30) Foreign Application Priority Data

Sep. 16, 2005 (DE) ..... 10 2005 044 435

(51) Int. Cl.
*D21F 1/10* (2006.01)
*B21F 27/18* (2006.01)

(52) U.S. Cl. ..... 162/348; 162/903; 428/222

(58) Field of Classification Search ..... 162/348, 162/358.2, 900, 902, 903; 139/383 A, 425 A; 28/110, 142; 29/435; 245/6; 474/206, 208; 198/850–853; 428/222, 371, 397, 401; 34/95, 34/116, 123
See application file for complete search history.

(56) References Cited

U.S. PATENT DOCUMENTS 4,362,776 A * 12/1982 Lefferts et al. ..... 428/222
4,381,612 A * 5/1983 Shank ..... 34/116
4,567,077 A * 1/1986 Gauthier ..... 428/114
4,583,302 A * 4/1986 Smith ..... 34/116
4,588,632 A * 5/1986 Gisbourne et al. ..... 428/212
4,601,942 A * 7/1986 Finn et al. ..... 428/222
5,115,582 A 5/1992 Westhead ..... 34/123
5,217,577 A * 6/1993 Steiner ..... 162/232
5,534,333 A * 7/1996 Keller et al. ..... 428/222
6,186,209 B1 * 2/2001 Lanthier ..... 156/470
6,585,858 B1 7/2003 Otto et al.
2006/0124268 A1 * 6/2006 Billings ..... 162/348

FOREIGN PATENT DOCUMENTS

GB 2 083 431 A 3/1982
GB 2148337 10/1984
WO WO 2004/094275 11/2004

* cited by examiner

*Primary Examiner*—Eric Hug
(74) *Attorney, Agent, or Firm*—Taylor & Aust, P.C.

(57) ABSTRACT

A fabric, in particular for a paper making machine, includes a plurality of helically wound coil members arranged side by side with respect to each other in an intermeshing manner, such that connecting channels are formed by adjacent intermeshing coil members, a hinge member being introduced into and extending along each connecting channel for interconnecting adjacent coil members, a stuffer channel being formed within each coil member extending along and between two connecting channels associated to a respective coil member, at least a part of the stuffer channels being filled with stuffer members extending longitudinally within the stuffer channels, a stuffer material being provided at least in regions of the fabric for filling spaces formed within the fabric between the coil members, the hinge members and the stuffer members.

10 Claims, 2 Drawing Sheets

PAPERMACHINE CLOTHING

BACKGROUND OF THE INVENTION

1. Field of the Invention

The present invention relates to a fabric, in particular a fabric which can be used in a paper making machine.

2. Description of the Related Art

One type of such fabrics used in paper making machines is the so-called stuffed spiral link fabric. Such a fabric includes a plurality of helically wound coil members extending in the cross machine direction of the fabric. These coil members are arranged such that adjacent coil members are in an intermeshing relation with respect to each other such as to generate connecting channels into which hinge members are introduced. By way of these hinge members or hinge wires, which often are referred to as pintles, the adjacent coil members are articulated with respect to each other such that a flexible endless fabric can be obtained. Within each coil member and between the two connecting channels associated to such a coil member there is a further channel which is filled with a so-called stuffer member or stuffer yarn for providing a desired permeability. As is the case with the hinge members or hinge wires, these stuffer members or stuffer yarns extend in the longitudinal direction of the coil members.

When producing such a fabric, after having arranged the coil members in an intermeshing position and after having introduced the hinge wires and possibly the stuffer yarns, the fabric is exposed to heat while putting the structure under tension. This serves for stabilizing the structure and for providing the final shape.

One problem with such a fabric is that the tension applied to the fabric during the paper making process in a paper machine may differ from the one as applied during the heat setting process. Particularly when the tension applied during the paper making process is substantially higher than the tension applied during the heat setting process, there occurs a stretching of the fabric leading to an undesired change in the permeability.

From GB 2 148 337 A there is known such a fabric in which the spaces formed within the fabric between the coil members and the hinge wires are filled with an elastomeric open-cell foam. The foam is applied to the fabric in liquid form such that even small gaps can be filled. One problem of such a fabric is that these fabrics, after having been used in a paper making process, often are cleaned by means of a jet of high pressure water or air or steam directed against the fabric surface in order to remove contaminants. Especially if water is used, the operating pressure may be up to 350 bar. Such a high pressure jet directed to the fabric surface leads to the problem of dislodgement and removal of foam material such that again there occurs a change in the permeability of the fabric.

SUMMARY OF THE INVENTION

The present invention provides a fabric, in particular for paper making machines, having a predetermined permeability which is substantially constant during the operating lifetime of such a fabric.

The present invention provides a fabric, in particular for a paper making machine, including a plurality of helically wound coil members arranged side by side with respect to each other in an intermeshing manner, such that connecting channels are formed by adjacent intermeshing coil members, a hinge member being introduced into and extending along each connecting channel for interconnecting adjacent coil members, a stuffer channel being formed within each coil member extending along and between two connecting channels associated to a respective coil member, at least a part of the stuffer channels being filled with stuffer members extending longitudinally within the stuffer channels, a stuffer material being provided at least in regions of the fabric for filling at least in part the space formed within the fabric between the coil members, the hinge members and the stuffer members.

By filling at least a part of the spaces formed within the fabric with additional stuffer material, the permeability of such a fabric can be varied in a wide range, so that it is possible to provide a fabric having a desired low permeability for water and air and such materials. Since the stuffer material is introduced into the spaces formed between the coil members, the hinge members and the stuffer members, this stuffer material is in contact with a large overall surface of the different members constituting the fabric, so that it is fixedly anchored to the fabric. The risk of dislodging the stuffer material, for example when cleaning the fabric with a high pressure water jet, is substantially reduced.

It has been found that polymeric resin can be used as material for the stuffer material. For example silicones and polyurethanes can be used. Other usable materials are epoxy resin, phenolic resin, thermoplastic elastomer as for instance ethylene vinylacetate.

In particular, in cases in which such fabrics are used in paper making machines, the quality of the produced paper depends on the permeability of the fabric used in the drying section of such a paper making machine. For providing a substantially constant paper quality, it can be advantageous if the stuffer material is substantially uniformly distributed over the fabric, as this leads to a substantially uniform permeability of the overall fabric.

To compensate for nonuniform drying behavior of a paper making machine or to influence the paper quality, e.g. in the cross machine direction, it can be advantageous if the fabric includes regions of higher stuffer material density and regions of lower stuffer material density. The regions of higher stuffer material density for example may include the lateral edge regions of the fabric. Thus paper with a smaller extension in the cross machine direction may be produced without leading to the problem of adversely influencing the negative pressure applied to the fabric and the paper raw material.

For some applications in the paper making machine it can be useful if the stuffer material is applied to both sides of the fabric. In cases in which the fabric is used in a paper making machine these sides are the paper side and the machine side.

In another embodiment the stuffer material may be applied only to one side of the fabric which is a machine side remote from a paper side of the fabric. As normally during a cleaning process of such a fabric a high pressure water jet or air jet is directed to the paper side, the risk of dislodging stuffer material during the cleaning process can be further reduced by applying the stuffer material only to the machine side.

In another embodiment the coil members used in different regions of the fabric can be of different colors. This color coding of the fabric can be detected by an optical detection system of a stuffer material dispensing apparatus and can be used as a trigger for applying the stuffer material only to particular color coded regions of the fabric. Of course, such a color coding can be obtained additionally or alternatively by using differently colored stuffer members in different regions of the fabric.

According to a further aspect the present invention relates to a fabric, in particular for a paper making machine, including a plurality of helically wound coil members arranged side by side with respect to each other in an intermeshing manner, such that connecting channels are formed by adjacent intermeshing coil members, a hinge member being introduced into and extending along each connecting channel for interconnecting adjacent coil members, a stuffer material of polymeric resin being provided at least in regions of the fabric for filling at least in part the space formed within the coil members.

It has been found that by using a polymeric resin stuffer material it becomes possible to influence the permeability of such a fabric in a wide range, while at the same time the risk of dislodging stuffer material during a cleaning process or during the operation of the fabric is substantially reduced.

According to a further aspect the present invention relates to a method for producing a fabric, in particular for a paper making machine, the fabric including a plurality of helically wound coil members arranged side by side with respect to each other in an intermeshing manner, such that connecting channels are formed by adjacent intermeshing coil members, a hinge member being introduced into and extending along each connecting channel for interconnecting adjacent coil members, a stuffer channel being formed within each coil member extending along and between two connecting channels associated to a respective coil member, at least a part of the stuffer channels being filled with stuffer members extending longitudinally within the stuffer channels, said method including the step of applying a stuffer material at least to regions of the fabric for filling spaces formed within the fabric between the coil members, the hinge members and the stuffer members.

As already stated above the stuffer material can be polymeric resin and it can be applied to the fabric from both sides thereof or only from one side, in particular the side which is the machine side remote from the paper side of the fabric.

For influencing the permeability distribution of a fabric, the stuffer material can be applied to the fabric such as to generate a substantially uniform stuffer material distribution over the fabric leading to a substantially uniform permeability distribution over the fabric, or can be applied such as to generate regions of higher stuffer material density, i.e. regions of lower permeability, and regions of lower stuffer material density, i.e. regions of higher permeability.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE PREFERRED EMBODIMENT

Figure 1:
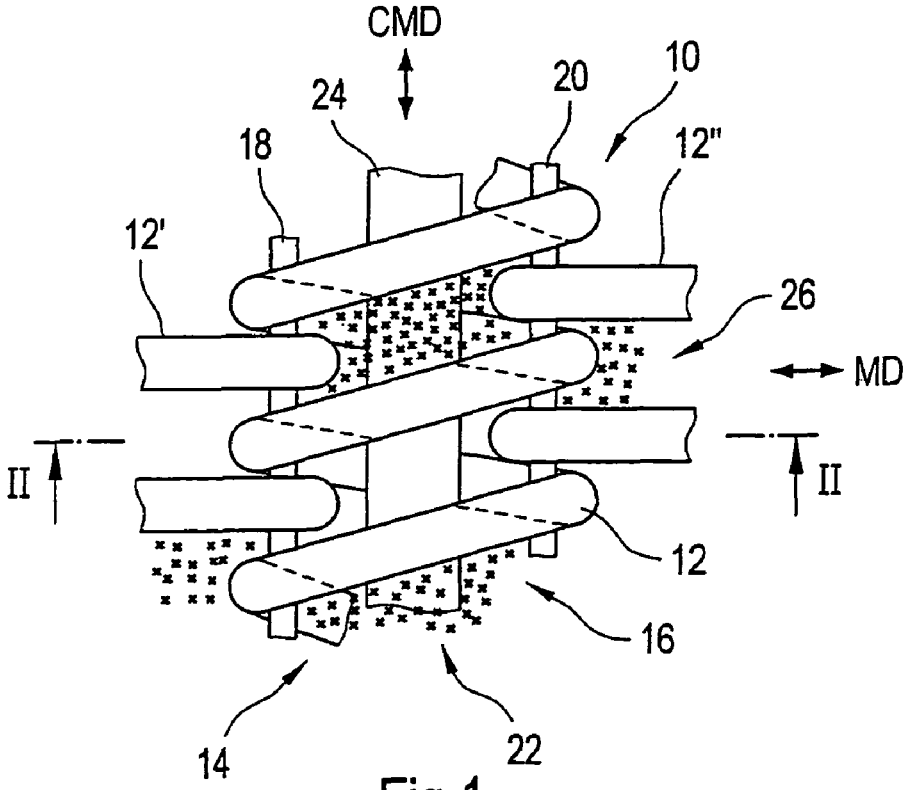
FIG. 1 is a top view of a portion of a fabric as viewed in direction I in FIG. 2.
Figure 2:
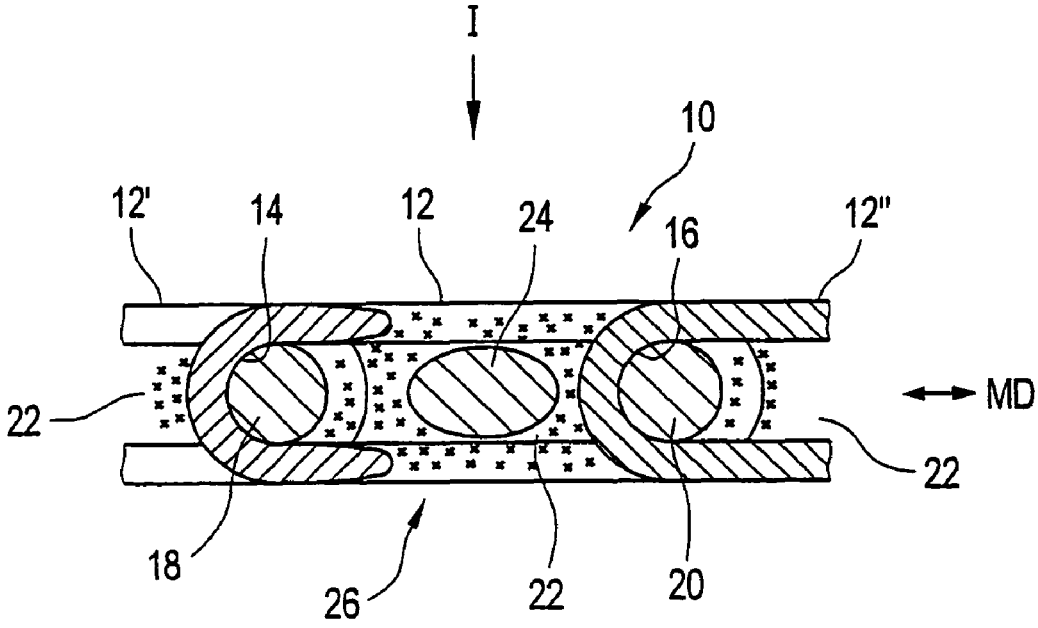
FIG. 2 is a sectional view taken along line II-II of the fabric shown in FIG. 1.

Referring now to the drawings, and more particularly to FIGS. 1 and 2, there is shown a portion of a fabric 10 of the present invention. This fabric 10 for example can be used in the drying section of a paper making machine and in this case constitutes an endless belt.

The fabric 10 includes a plurality of helically wound coil members 12, 12', 12" which are arranged such as to extend in a cross machine direction CMD with their longitudinal axes. Immediately adjacent coil members 12, 12', and 12" are arranged in an intermeshing manner. As can be seen from FIG. 1, for example the windings of coil members 12' and 12" engage the gaps between the windings of coil member 12 and vice versa. By providing such a mutually intermeshing arrangement of adjacent coil members 12, 12', and 12", in the regions of engagement there are formed connecting channels 14, 16. As can be seen in FIG. 2, the connecting channel 14 is defined by both of the coil members 12 and 12', whereas the connecting channel 16 is defined by both of the coil members 12 and 12".

For connecting the adjacent and intermeshing coil members 12, 12', and 12", a respective hinge member 18, 20 is introduced into the connecting channels 14, 16. By way of these hinge members or hinge wires the adjacent coil members 12, 12', and 12" are connected to each other such as to be pivotable about each of the hinge members 18, 20. Therefore a flexible overall structure of the fabric 10 is obtained.

Between the two connecting channels 14, 16 formed within each of the coil members 12, 12', and 12" and spaced in the machine direction MD with respect to each other, there is provided a stuffer channel 22. The stuffer channel 22 of each of the coil members 12, 12', and 12" is filled with a respective stuffer member 24 introduced into the stuffer channel 22 such as to extend in the cross machine direction CMD and substantially parallel to the hinge members 18, 20. These stuffer members 24 are provided for filling at least a part of the spaces formed within the coil members 12, 12', and 12" for reducing the permeability of the fabric 10. By selecting the width and the cross sectional shape of the stuffer members 24, the permeability of such a fabric 10 can be varied in a wide range. These stuffer members 24, which often are called stuffer yarns, can be monofilament yarns, multifilament yarns, spun yarns, sheet material, film material etc.

Figure 4:
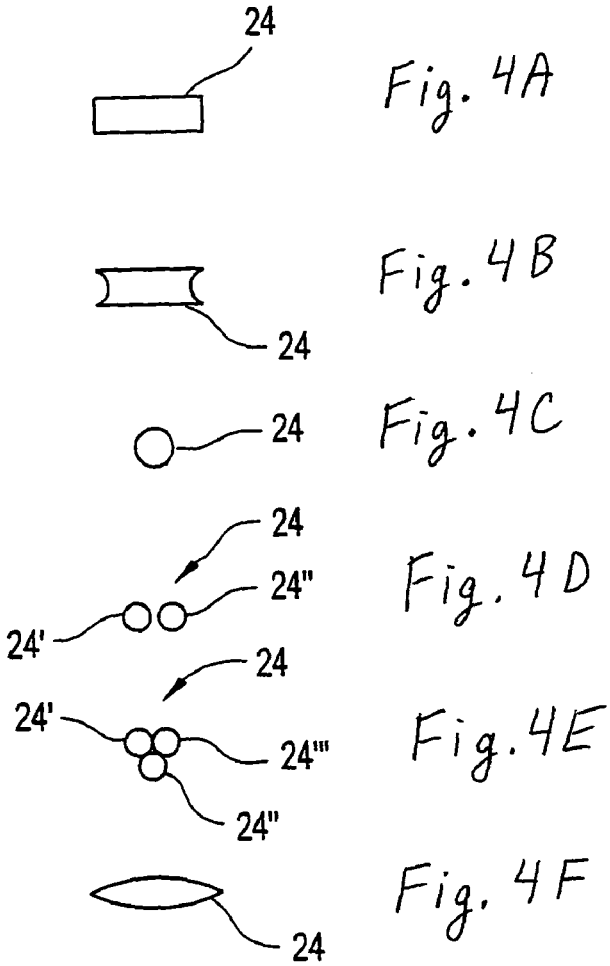
FIGS. 4A-4F are different cross sectional shapes of stuffer members usable in the fabric of the present invention.

FIG. 4 shows some cross sections of such stuffer members or stuffer yarns 24, that can be used in the fabric 10 of the present invention. For example FIG. 4A shows a stuffer member 24 having a flattened rectangular shape. The stuffer member 24 of FIG. 4B also has a substantially flattened cross sectional shape with concavely shaped side faces. FIG. 4C shows a stuffer member or stuffer yarn 24 having a circular cross sectional shape and being of the so-called monofilament stuffer yarn type. In FIG. 4D there is shown a multifilament stuffer member or stuffer yarn 24 composed of two individual yarn members 24', 24". The stuffer yarn 24 of FIG. 4D is of the so-called multifilament yarn type. In FIG. 4E there is shown a further multifilament stuffer yarn including three yarn members 24', 24", and 24'". When using such multifilament stuffer yarns 24, the respective yarn members may run parallel without any kind of mutual interlacement. Of course it is possible to use twisted or interlaced yarn members. FIG. 4F shows a further monofilament stuffer member or stuffer yarn 24 having a flattened, lens shaped cross sectional area. The selection of a particular stuffer member or stuffer yarn mainly depends on the desired permeability of the fabric 10 to be produced.

The coil members 12, 12', and 12" and the stuffer members 24 of the fabric 10 may be of polymeric material. The hinge members 18, 20 may also be of polymeric material.

Figure 3:
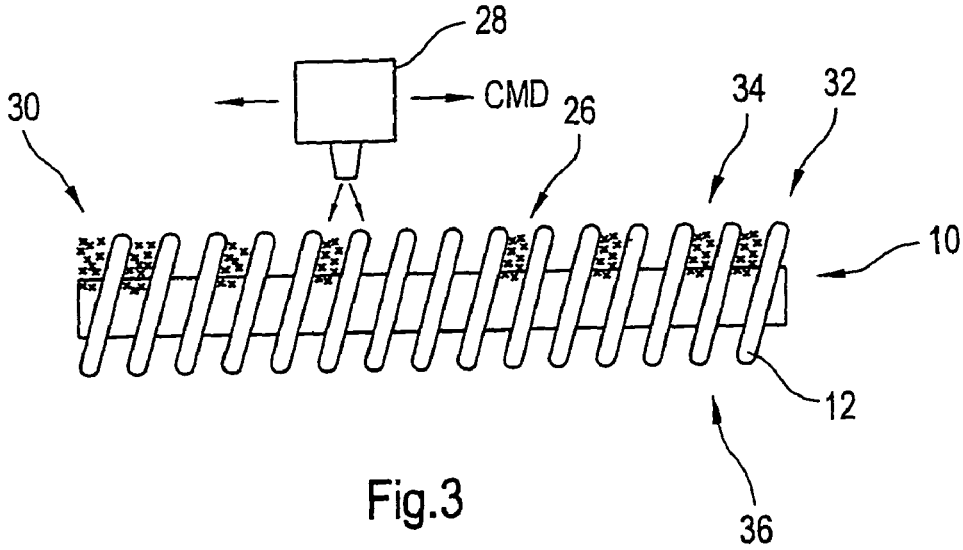
FIG. 3 is a front view of a fabric for showing the stuffer material distribution in a cross machine direction.

For assembling and bringing the fabric 10 into a shape as shown for example in FIG. 2, after inserting the hinge members 18, 20 into the connecting channels 14, 16 and after inserting the stuffer members 24 into the stuffer channels 22, heat and machine direction tension can be applied to the fabric 10 such that the material of the coil members is brought in a condition in which it is deformable. Applying a tension in the machine direction leads to a flattening of the coil members such that the shape shown in FIG. 2 is obtained. After the fabric 10 has been brought into the desired shape, according to the present invention stuffer material is additionally applied to the fabric 10. In FIGS. 1, 2, and 3 this stuffer material 26 is indicated as "x". This stuffer material consists of polymeric resin (for example, silicones or polyurethanes or epoxy resin, phenolic resin, thermoplastic elastomer as for instance ethylene vinylacetate) and is applied to the fabric 10 in predetermined regions and predetermined amounts. As shown in FIG. 3, the stuffer material 26 can be applied to the fabric 10 by using a delivery system 28 which is movable across the fabric 10 in the cross machine direction CMD. The delivery system 28 is able to deliver small amounts of the stuffer material in a fluidized condition such that rather small regions of the fabric 10 can be supplied with the stuffer material 26. For example, as shown in FIG. 2, such a region may include the space between two windings of a coil member 12 following each other in the cross machine direction CMD. The stuffer material 26 applied to the fabric 10, due to its fluidized or flowable condition, is able to penetrate into the interior empty spaces of the fabric 10 which are defined by the coil members, the hinge members, and the stuffer members. The degree of penetration of course depends on the viscosity of the used stuffer material 26 and the size of the gaps defined in the fabric 10.

The locations at which the stuffer material 26 is applied to the fabric 10 may for example be selected such that a substantially uniform distribution of the stuffer material 26, i.e. those locations, at which stuffer material 26 is applied, across the fabric 10 is generated. As those regions, in which the stuffer material 26 is present, substantially are not permeable for air and water, there is a correspondingly uniform permeability of the fabric 10 when considering the overall surface thereof. It may be desirable, however, to provide a non-uniform permeability distribution across the surface of the fabric 10. In this case the delivery system 28 is controlled such as to discharge the flowable stuffer material 26 in a pattern corresponding to the desired distribution of the permeability. For example, as shown in FIG. 3, it may be desirable to provide a smaller permeability in the lateral edge regions 30, 32 of the fabric 10, while in the middle region there is provided a higher permeability. For obtaining such a condition when applying the stuffer material 26 to the fabric 10, for example the delivery system 28 will discharge the flowable stuffer material 26 into each of the gaps between adjacent windings of a coil member in the lateral edge regions 30, 32, whereas towards the middle of the fabric 10 the number of gaps into which no stuffer material 26 is ejected is higher or increases.

Further, the flowable stuffer material 26 may be applied to the fabric 10 only from one side. For example the stuffer material 26 may be applied only to the machine side 34 of the fabric 10, i.e. the side, which is remote from the paper side 36. This leads to the advantage that when cleaning the paper side 36 of such a fabric 10 by using a high pressure water jet or air jet the risk of dislodging parts of the stuffer material 26 can be reduced. Of course it is also possible to apply the stuffer material 26 to both sides 34 and 36 of the fabric 10, as for example shown in FIG. 2. In both cases the air or water permeability of such a region of the fabric 10 in which the stuffer material 26 is present, can be reduced down to zero cfm.

After the stuffer material 26 has been applied to the fabric 10 at the desired locations and with the desired amount by using the computer controlled delivery system 28, the stuffer material 26 which still is in a flowable condition for allowing the desired and necessary penetration thereof into the internal spaces of the fabric 10, a cleaning device, such as for example a doctor blade or the same, may be used for removing the stuffer material 26 which has been deposited in undesired regions, for example on the top surface of the fabric, or which has been deposited in excess of the desired amount. After this optional cleaning procedure the still flowable stuffer material 26 is cured. This can be done by applying heat, moisture, electromagnetic radiation or by waiting until the chemical curing reaction has occurred within the stuffer material 26. After this curing process the fabric 10 has the desired permeability and the desired distribution of the permeability across its surface. Due to the fact that the stuffer material 26 is applied in a flowable condition into the spaces defined by the coil members, the hinge members and the stuffer members, the cured stuffer material 26 is fixedly anchored to the fabric 10. As already stated above, exposing such a fabric and the stuffer material 26 to high pressure fluid jets does not involve the risk of dislodging even small portions of the stuffer material 26, in particular if the paper side 36 is cleaned by using such a system, while the major portion of the stuffer material 26 is present at the machine side 34 or nearer to the machine side 34 of the fabric. In particular this single sided deposition of the stuffer material 26, i.e. the protection of the applied stuffer material 26 against cleaning material jets, allows a greater choice of materials for this stuffer material 26. In particular it is possible to use a more bendable or flexible material such that the flexing behavior of the fabric 10 is not adversely affected.

The present invention provides stuffer members within the coil members and stuffer material at particular locations and allows a wide range of variation of the permeability. In particular it will become possible to adjust the permeability in a range of 0 $m^3/m^2/hr$ up to 3658 $m^3/m^2/hr$ (0 cfm up to 200 cfm), preferably 1097 $m^3/m^2/hr$ up to 2743 $m^3/m^2/hr$ (60 cfm up to 150 cfm).

The fabric and the process for producing the same as explained above may be varied in a plurality of aspects without deviating from the present invention. For example the coil members and/or the stuffer members used for the fabric 10 may be varied in their color such as to provide differently colored regions across the fabric 10. This color coding then can be used as a trigger for the delivery system 28 for example for applying the stuffer material only to regions of the fabric 10 which have a predetermined color. Further, the shown distribution of the stuffer material 26 can be varied in accordance with the desired local or overall permeability of such a fabric.

Further, the process of applying the stuffer material as well as the process of curing the stuffer material can involve a movement of the delivery system and the curing system respectively but also can additionally or alternatively involve a movement of the fabric 10 in its cross machine direction and/or its machine direction.

Finally, the expression "uniform distribution of the stuffer material 26" does not necessarily mean that in such a region of uniform distribution there is a closed layer or bulk material of the stuffer material. Instead this expression also is intended to mean that within a predetermined area of the fabric there are a plurality of stuffer material dots or zones, which in this area are distributed substantially uniformly and therefore lead to a corresponding uniform permeability of the fabric in this area.

What is claimed is:

1. A fabric for use in a paper making machine, said fabric comprising:

a plurality of helically wound coil members arranged side by side with respect to each other in an intermeshing manner, adjacent intermeshing said coil members forming a plurality of connecting channels;

a plurality of hinge members, each said hinge member introduced into and extending along each of said connecting channels for interconnecting adjacent said coil members;

a stuffer channel formed within each said coil member, said stuffer channel extending along and between two said connecting channels associated with a respective said coil member;

at least one stuffer member at least partially extending within said stuffer channel, said stuffer member, said coil members, and said hinge members forming a space therebetween within the fabric; and a stuffer material provided at least in regions of the fabric for filling at least in part said space, said stuffer material applied only to a machine side of the fabric, said stuffer material being substantially uniformly distributed over the fabric and thereby causing the fabric to be uniformly permeable relative to an overall machine side surface of the fabric.

2. The fabric according to claim 1, wherein said stuffer material is polymeric resin.

3. The fabric according to claim 1, wherein the fabric comprises a plurality of regions of higher stuffer material density and a plurality of regions of lower stuffer material density.

4. The fabric according to claim 3, wherein the fabric has a plurality of lateral edge regions and wherein said regions of higher stuffer material density comprise said lateral edge regions of the fabric.

5. The fabric according to claim 1, wherein said coil members are used in different regions of the fabric and wherein said coil members which are used in different regions of the fabric are of different color.

6. The fabric according to claim 1, further comprising a plurality of said stuffer member, wherein said stuffer members are used in different regions of the fabric and wherein said stuffer members which are used in different regions of the fabric are of different color.

7. A fabric for use in a paper making machine, said fabric comprising:

a plurality of helically wound coil members arranged side by side with respect to each other in an intermeshing manner, adjacent intermeshing said coil members forming a plurality of connecting channels, said coil members forming a space within said coil members;

a hinge member introduced into and extending along each said connecting channel for interconnecting adjacent said coil members;

a stuffer material of polymeric resin provided at least in regions of the fabric for filling at least in part the space, said stuffer material applied only to a machine side of the fabric, said stuffer material being substantially uniformly distributed over the fabric and thereby causing the fabric to be uniformly permeable relative to an overall machine side surface of the fabric.

8. A method for producing a fabric for use in a paper making machine, said method comprising the steps of:

providing the fabric comprising:

a plurality of helically wound coil members arranged side by side with respect to each other in an intermeshing manner, adjacent intermeshing said coil members forming a plurality of connecting channels;

a plurality of hinge members, each said hinge member introduced into and extending along each of said connecting channels for interconnecting adjacent said coil members;

a stuffer channel formed within each said coil member, said stuffer channel extending along and between two said connecting channels associated with a respective said coil member;

at least one stuffer member at least partially extending within said stuffer channel; and applying a stuffer material at least to regions of the fabric for filling spaces formed within the fabric between said coil members, said hinge members, and said stuffer member, said stuffer material applied only to a machine side of the fabric, said stuffer material being substantially uniformly distributed over the fabric and thereby causing the fabric to be uniformly permeable relative to an overall machine side surface of the fabric.

9. The method according to claim 8, wherein said stuffer material is polymeric resin.

10. The method according to claim 8, wherein said stuffer material is applied to the fabric to generate a plurality of regions of higher stuffer material density and a plurality of regions of lower stuffer material density.

* * * * *